US006926365B2

(12) United States Patent
Bottoms

(10) Patent No.: US 6,926,365 B2
(45) Date of Patent: Aug. 9, 2005

(54) BODY SUPPORT FOR AUTOMOTIVE MECHANICS

(75) Inventor: Gary D. Bottoms, Fort Mill, SC (US)

(73) Assignee: Auto Products, Inc., Fort Mill, SC (US)

( * ) Notice: Subject to any disclaimer, the term of this patent is extended or adjusted under 35 U.S.C. 154(b) by 0 days.

(21) Appl. No.: 10/624,281

(22) Filed: Jul. 22, 2003

(65) Prior Publication Data

US 2005/0076609 A1 Apr. 14, 2005

Related U.S. Application Data

(63) Continuation of application No. 09/975,710, filed on Oct. 10, 2001, now Pat. No. 6,595,590, which is a continuation-in-part of application No. 09/599,670, filed on Jun. 22, 2000, now Pat. No. 6,540,301.

(60) Provisional application No. 60/140,668, filed on Jun. 24, 1999.

(51) Int. Cl.[7] ..... B25H 5/00

(52) U.S. Cl. ..... 297/423.12; 297/488; 297/338; 182/129

(58) Field of Search ..... 297/423.11–423.13, 297/338, 451.3, 452.2, 488, 487; 135/65, 135/66; 182/115, 116, 129; 403/109.1, 109.3, 403/109.6, 109.8

(56) References Cited

U.S. PATENT DOCUMENTS

| | | | | |
|---|---|---|---|---|
| 2,701,168 A | | 2/1955 | Schemers | |
| 2,872,252 A | | 2/1959 | Konkle | |
| 2,969,123 A | | 1/1961 | Jamerson et al. | |
| 3,863,978 A | | 2/1975 | Gillings, Jr. | |
| 3,976,155 A | | 8/1976 | Esch | |
| 4,072,209 A | | 2/1978 | Bolis | |
| 4,109,961 A | | 8/1978 | Opsvik | |
| 4,397,374 A | | 8/1983 | Rumage et al. | |
| 4,530,419 A | * | 7/1985 | Rumage et al. | 182/106 |
| 4,542,806 A | | 9/1985 | Olson | |
| 4,650,249 A | | 3/1987 | Serber | |
| 4,653,808 A | | 3/1987 | Opsvik | |
| 4,690,459 A | | 9/1987 | Ullman | |
| 4,727,958 A | * | 3/1988 | Botello | 182/15 |
| 4,800,987 A | | 1/1989 | Liles | |

(Continued)

OTHER PUBLICATIONS

Rel Products; "Topside Creeper"; Published prior to Jun. 24, 1999; Entire brochure.

(Continued)

*Primary Examiner*—Peter R. Brown
(74) *Attorney, Agent, or Firm*—Adams Evans P.A.

(57) ABSTRACT

A mechanic's body support including first and second horizontally-oriented and spaced-apart base rails and first and second spaced-apart support rails. Each of the support rails has one end connected to a respective one of the first and second base rails. Each support rail also extends upwardly from and is in vertical alignment with the base rails for supporting a mechanic as he kneels in an elevated position over the engine compartment of a motor vehicle. A chest pad and a knee pad are mounted in spaced-apart relation between the support rails for securing the support rails in a fixed, spaced-apart relation, and for supporting the chest and knees of the mechanic while in the kneeling position, thus allowing the skeletal structure of the body to support the weight, rather than the back and leg muscles.

14 Claims, 8 Drawing Sheets

U.S. PATENT DOCUMENTS 4,867,273 A * 9/1989 Schaevitz ..... 182/116
5,029,671 A 7/1991 Larson
5,072,955 A 12/1991 Holland et al.
5,099,951 A 3/1992 Stockwell
5,167,436 A 12/1992 Wu
5,600,857 A 2/1997 Heilmann
5,669,669 A 9/1997 Usher
5,762,402 A 6/1998 Gillotti
6,017,089 A 1/2000 Mengshoel
6,105,719 A 8/2000 Lensing

OTHER PUBLICATIONS

"Automotive Cerrpers, Seats & More"; Published prior to Jun. 24, 1999.

* cited by examiner

BODY SUPPORT FOR AUTOMOTIVE MECHANICS

This application is a continuation of U.S. patent application Ser. No. 09/975,710, filed Oct. 10, 2001, now U.S. Pat. No. 6,595,590, which is a continuation-in-part of U.S. patent application Ser. No. 09/599,670, filed Jun. 22, 2000, now U.S. Pat. No. 6,540,301, which claims the benefit of U.S. Provisional Application No. 60/140,668, filed Jun. 24, 1999.

TECHNICAL FIELD AND BACKGROUND OF INVENTION

This invention relates to a body support for mechanics. While the preferred embodiments disclosed herein are of body supports for providing support to mechanics as they repair motor vehicles, the body support of the present invention could clearly be used in any environment where an individual finds it necessary to lean over the equipment, object or project upon which the individual is working, including those involving the provision of medical or veterinary services. Although the vehicle referred to throughout this application is a motor vehicle, it is understood that the invention relates as well to other types of vehicles or equipment including but not limited to airplanes, boats, or other heavy machinery.

In many instances, an automotive mechanic working in an automotive repair shop requires an apparatus to lean against or kneel upon which provides more physical support as he leans over engine compartment of a motor vehicle to inspect and/or repair the components located therein. Using such an apparatus not only enhances the overall comfort of the mechanic as he works, but ultimately increases his productivity. In addition, without sufficient lumbar and thoracic support, an automotive mechanic who repeatedly bends over an engine compartment is also at increased risk for spinal injuries, which are often accompanied by neurological and orthopedic complications. While body supports for mechanics are available, such supports lack features for maximizing comfort and safety of the mechanic while maintaining the stability of the support. Such supports also do not provide proper leverage to the mechanic when the support is used in both front-of-vehicle and side-of-vehicle positions.

The invention of the present application provides an effective solution for providing increased comfort to mechanics, improving overall productivity and decreasing the risk of injuries resulting from working over an engine compartment without using adequate supplementary support. The mechanic's body support takes advantage of a chest pad and knee pad which allows the mechanic's body weight to be supported by his rigid body structure rather than the back and leg muscles. This provides enhanced support to the chest and knees of a mechanic as he works on the engine of a motor vehicle. Additional features of the invention include not only means for adjusting the chest and knee pads, but also for adjusting the rails upon which these pads are attached, which further enhances the overall support provided to the mechanic.

SUMMARY OF THE INVENTION

Therefore, it is an object of the invention to provide a body support for automotive mechanics that maximizes the physical comfort: of a mechanic as he kneels over the engine compartment of a vehicle.

It is another object of the invention to provide a body support for automotive mechanics that maximizes the leverage available to a mechanic as he leans over the engine compartment of a vehicle.

It is another object of the invention to provide a body support for automotive mechanics that can be adjusted for increased stability as necessary.

It is another object of the invention to provide a body support for automotive mechanics that may be used either in front of a vehicle or to the side of a vehicle.

It is another object of the invention to provide a body support for automotive mechanics that can be conveniently adapted for use with vehicles of various sizes.

It is another object of the invention to provide a body support for automotive mechanics that can be folded into a storage configuration when the body support is not in use.

These and other objects of the present invention are achieved in the preferred embodiments disclosed below by providing a mechanic's body support that includes first and second horizontally-oriented and spaced-apart base rails, and first and second spaced-apart support rails. Each of the support rails has one end connected to a respective one of the first and second base rails. The support rails diverge upwardly from and are in vertical alignment with the base rails for supporting a mechanic in an elevated position over the engine compartment of a motor vehicle. A chest pad and a knee pad are mounted in spaced-apart relation between the support rails for securing the support rails in a fixed, spaced-apart relation, and for supporting the chest and knees of the mechanic.

According to another preferred embodiment of the invention, the body support includes height adjustment means adapted for selectively mounting the knee pad in one of at least two vertical positions relative to the support rails.

According to yet another embodiment of the invention, the height adjustment means is adapted for selectively mounting the knee pad at one of at least two angles relative to the support rails.

According to yet another embodiment of the invention, the height adjustment means includes at least one slot defined by and extending through each support rail, and the knee pad includes at least one complementary post thereon for cooperating with the at least one slot.

According to yet another preferred embodiment of the invention, the slot and complementary post are each shaped whereby the post is wedged into a selected one of a plurality of notches defined by the slot in response to downward pressure of the knee pad on the post, thereby permitting vertical and pivotal movement of the knee pad relative to the support rail.

According to yet another preferred embodiment of the invention, each of the support rails includes length adjustment means for permitting the length the support rail to be adjusted by movement of the support rails relative to a respective one of the base rails.

According to yet another preferred embodiment of the invention, each of the base rails includes first and second tubular rail segments having respective straight and angled ends.

According to yet another preferred embodiment of the invention, each of the support rails includes third and fourth elongate tubular rail segments having respective upper and lower ends. Each of the lower ends is movably connected to a respective one of the angled ends of the first and second tubular rail segments of each base rail, and the upper ends are connected together by a U-shaped tubular member.

According to yet another preferred embodiment of the invention, the length adjustment means includes a first plate connected between the first and second elongate tubular rail segments of the base rail. A first hole is defined in and extends through the first plate. A second plate is connected between the third and fourth tubular rail segments of the support rail and includes a vertically-oriented series of second holes defined therethrough at spaced-apart intervals. The length adjustment means also includes a locking pin adapted for being inserted through the first hole and then through a selected one of the second holes for releasably locking the support rails into a selected one of a plurality of vertical positions relative to the base rail.

According to yet another preferred embodiment of the invention, the body support includes including a U-shaped tubular rail adapted for receiving, the chest pad thereon and having terminal ends. Each of the ends is pivotally connected to a respective one of the U-shaped tubular members for positioning the chest pad relative to the support rails and base rails.

According to yet another preferred embodiment of the invention, the chest pad includes locating members defining complementary rail-receiving indents adapted for receiving the U-shaped tubular rail therein for connecting the chest pad to the U-shaped tubular rail.

According to yet another preferred embodiment of the invention, the body support includes a first pivot connected to each upper support rail segment for pivotally connecting a respective one of the terminal ends of the U-shaped tubular rail thereto for permitting limited movement of the U-shaped tubular rail through an arc for adjusting the pitch of the chest pad.

According to yet another preferred embodiment of the invention, the first pivot includes a third plate connected between the third and fourth tubular rail segments of the support rail. At least one slot is defined by the third plate and extends therethrough. The at least one slot includes a series of notches defined therein at spaced-apart intervals. At least one complementary post is included on each of the ends of the U-shaped tubular rail for cooperating with the at least one slot for permitting pivotal movement of the U-shaped tubular rail relative to the support rails.

According to yet another preferred embodiment of the invention, the chest pad includes a fourth plate positioned between and connected to each of the locating members for permitting sliding movement of the chest pad relative to the U-shaped tubular rail.

According to yet another preferred embodiment of the invention, the body support includes at least one wheel positioned on a respective one of the first and second base rails for permitting the body support to roll as the body support is being moved.

According to yet another preferred embodiment of the invention, the base rails are adapted for being moved between an unfolded, fully-extended use configuration and a folded storage configuration for permitting the body support to be stored when not in use.

According to yet another preferred embodiment of the invention, the body support includes a hinge positioned on each of the base rails for permitting selective movement of the base rail between the use and storage configurations, respectively.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
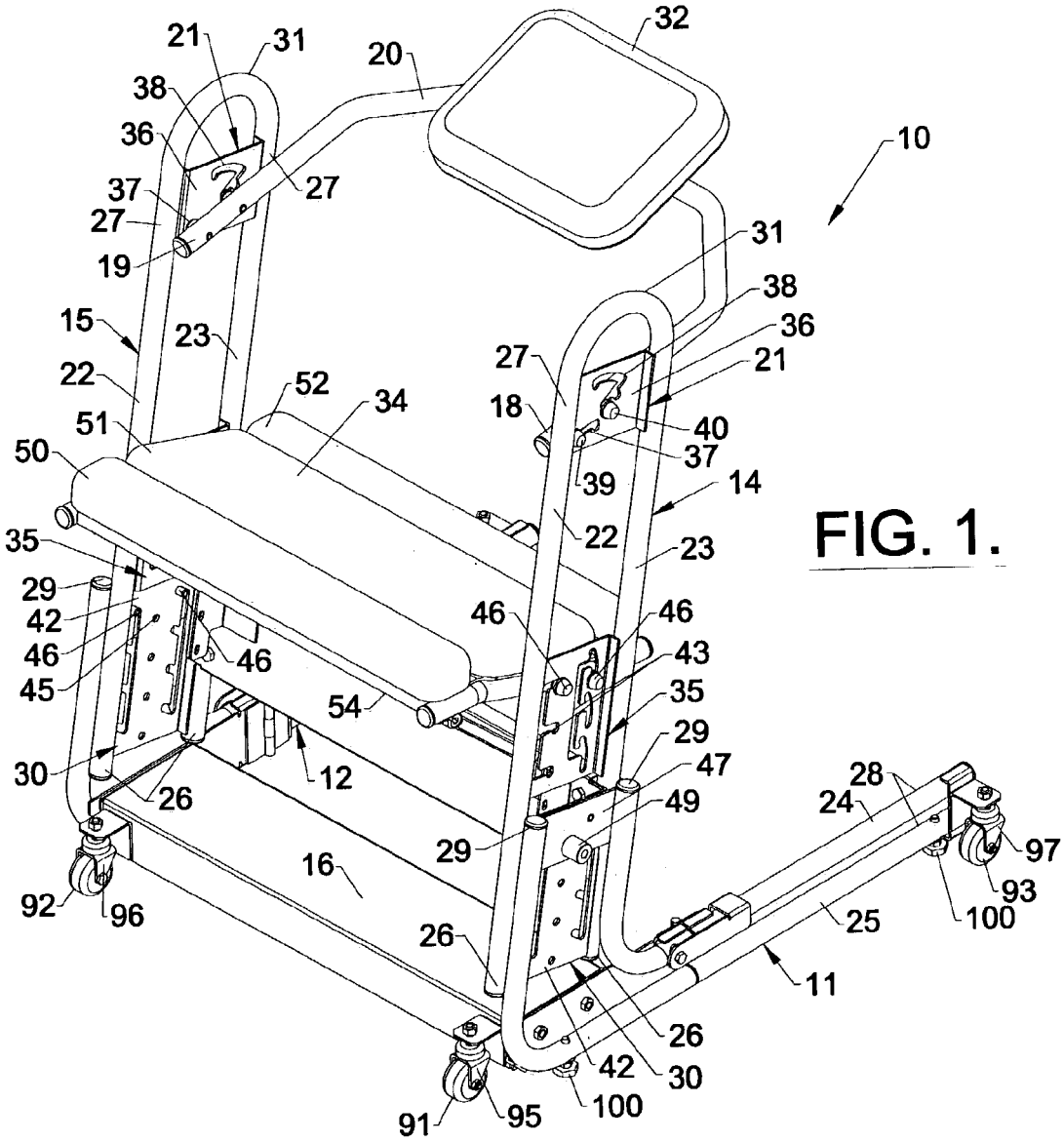
FIG. 1 is a perspective view of a mechanic's body support according to one embodiment of the invention.

Referring now specifically to the drawings, a mechanic's body support according to one preferred embodiment of the present invention is illustrated in FIG. 1 and shown generally at reference numeral 10. The body support 10 includes first and second horizontally-oriented base rail sections 11 and 12 which are connected to respective first and second vertically-oriented support rail sections 14 and 15 in a manner that permits the support rail sections 14 and 15 to extend upwardly away from respective base rail sections 11 and 12. This allows the body support 10 to be conveniently positioned either in front or to the side of the engine compartment of a motor vehicle so that a mechanic using the body support 10 can lean against the body support 10 for support and position himself over the engine compartment. A cross-support-member 16 is mounted between the base rail sections 11 and 12 for connecting the base rail sections 11 and 12 together.

Figure 2:
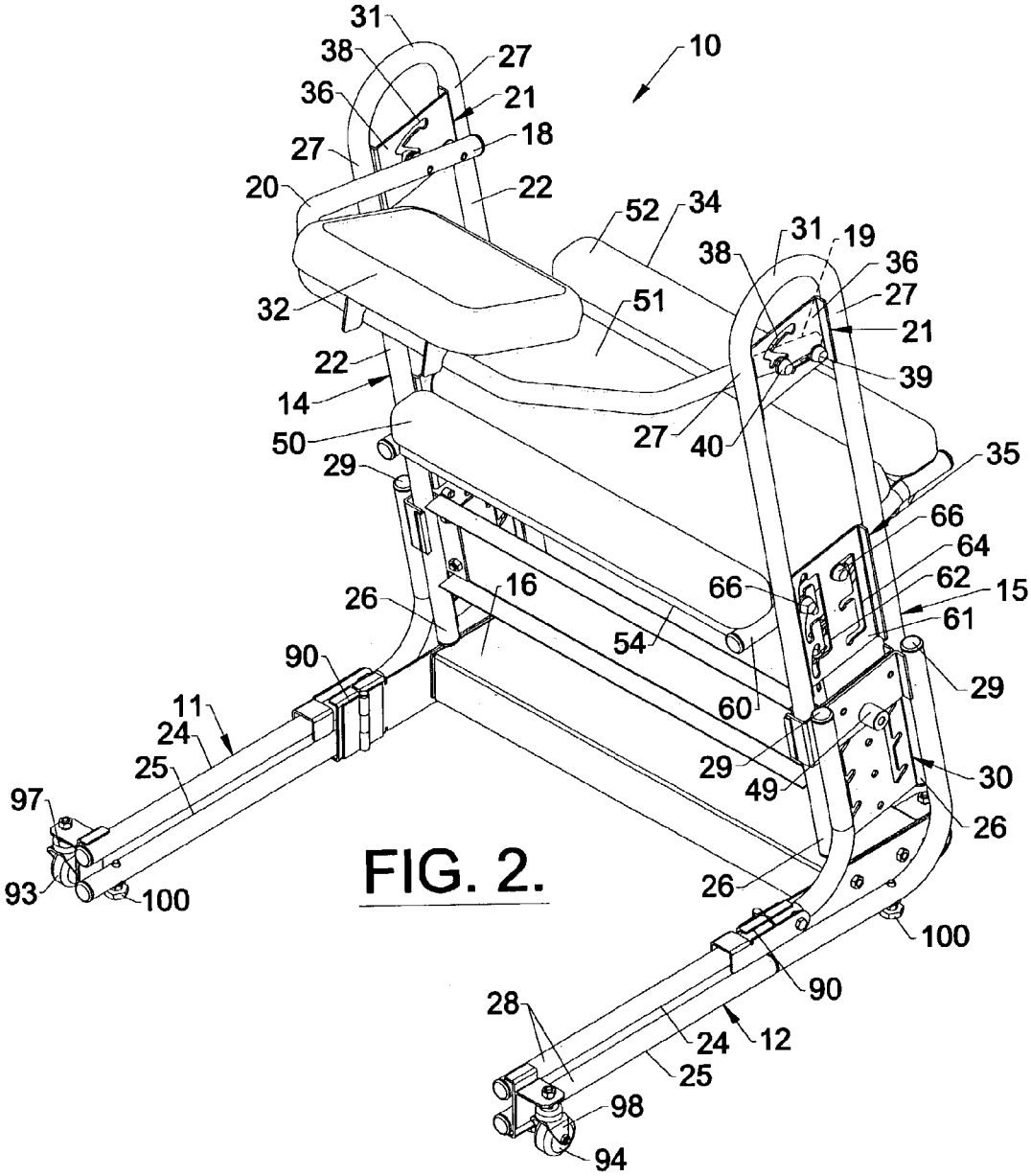
FIG. 2 is another perspective view of the mechanic's body support shown in FIG. 1.

Support rail sections 14 and 15 are attached to respective ends 18 and 19 of an upper support rail 20 by respective pivots 21, which are discussed more fully below. Although it may have any suitable shape, upper support rail 20 is preferably U-shaped. Support rail sections 14 and 15 are each formed from first and second tubular rails 22 and 23, respectively. As is shown in FIG. 2, respective base rail sections 11 and 12 are formed from respective third and fourth tubular rails 24 and 25. First and second tubular rails 22 and 23 each have respective first and second ends 26 and 27, and third and fourth tubular rails 24 and 25 each have respective straight and angled ends 28 and 29. As discussed in detail below, the first ends 26 of each pair of tubular rails 22 and 23 are connected to respective angled ends 29 by a slide 30. The second ends 27 each pair of tubular rails 22 and 23 are connected together by one of two U-shaped tubular members 31.

Referring again to FIG. 1, the body support 10 also includes a cushioned chest pad 32 mounted on the upper support rail 20, and a cushioned knee pad 34 mounted between the support rail sections 14 and 15. The chest pad 32 supports and cushions the chest of the mechanic and, as discussed more fully below, moves among four different positions in cooperation with upper support rail 20 and pivots 21. The knee pad 34 supports the knees of the mechanic and is mounted between support rail sections 14 and 15 using two sliding pivots 35. The pivots 35 allow the height and angle of the knee pad 34 to be adjusted.

While the chest pad 32 and knee pad 34 may be mounted at any point along the upper support rail 20 and support rail sections 14, 15, respectively, the chest pad 32 and knee pad 34 are preferably spaced apart from one another at a distance sufficient to permit a mechanic to comfortably lean his chest against the chest pad 32 and kneel upon the knee pad 34 without having the chest pad 32 extend past his shoulders and into his neck region. Together, the chest pad 32 and knee pad 34 provide comfort and support to the body trunk of the mechanic, thereby helping to reduce the incidence of back pain or other injuries the mechanic might otherwise experience if he were to work using inadequate supplemental body support, or no supplemental body support at all.

Figure 3:
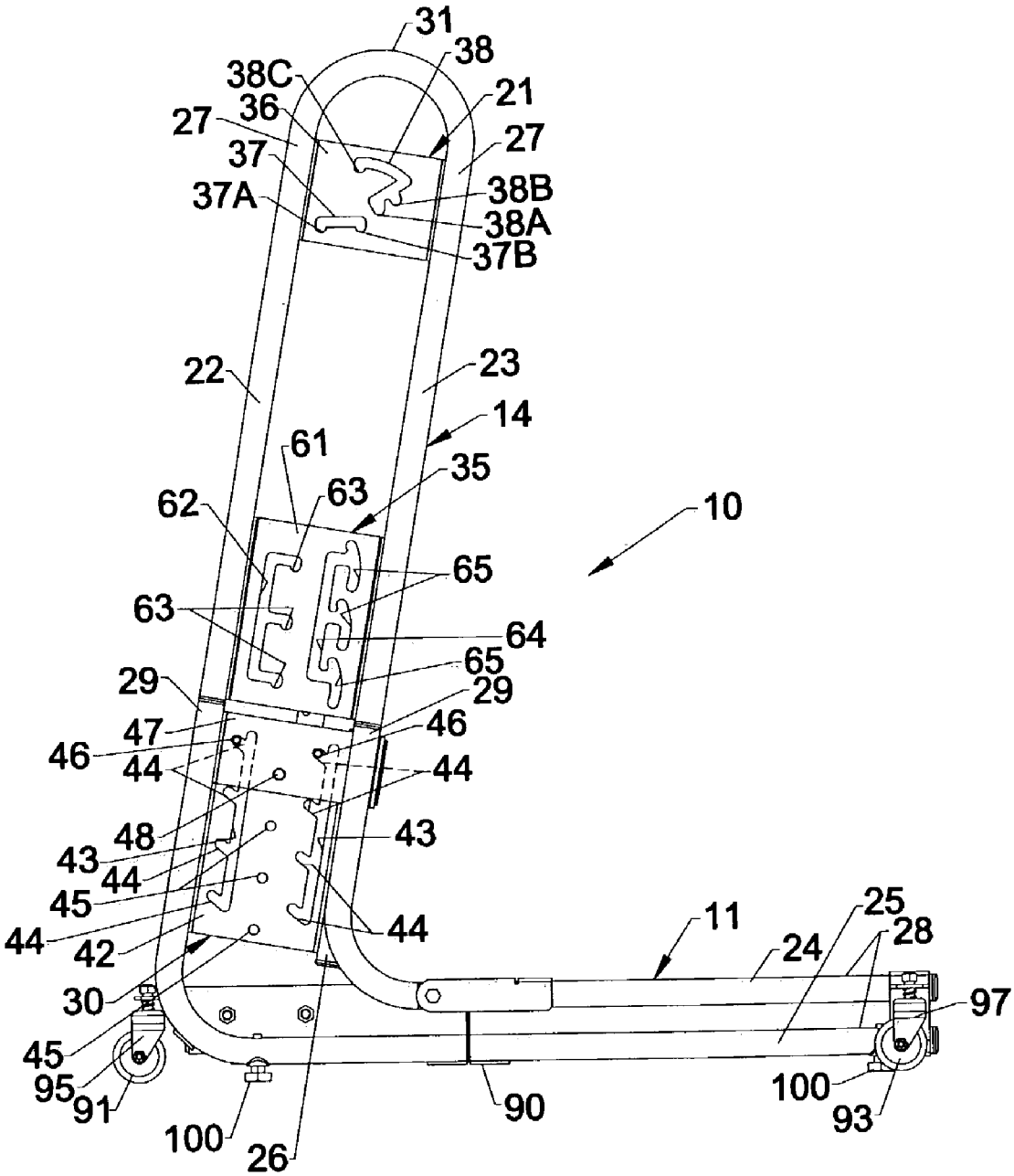
FIG. 3 is a side view of the mechanic's body support shown in FIG. 1 with the upper support rail, chest pad and knee pad removed.
Figure 4:
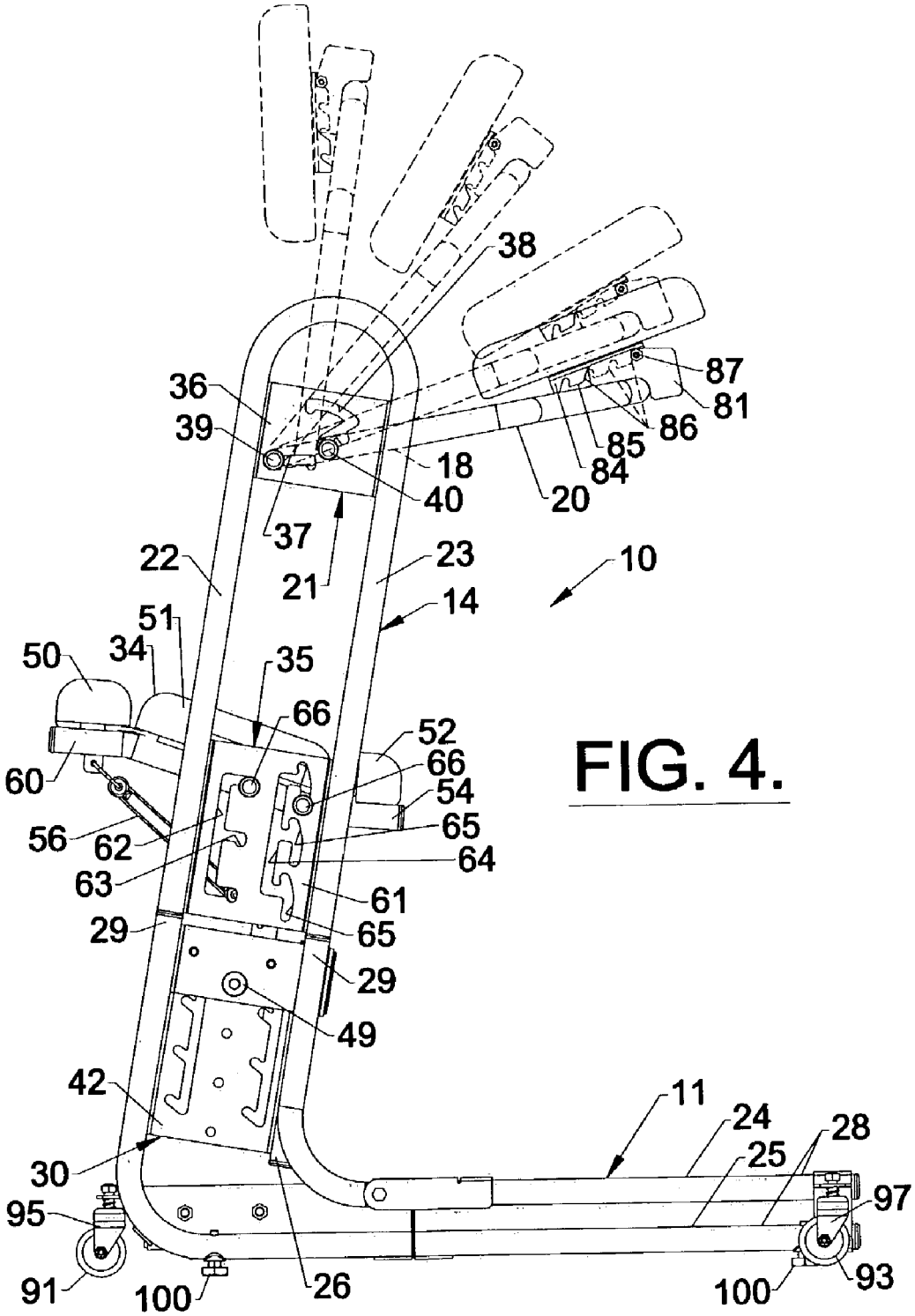
FIG. 4 is a side view of the mechanic's body support shown in FIG. 1.

As is shown in FIGS. 1 and 2, each pivot 21 includes a plate 36 which is attached to the second ends 27 of one of the pairs of first and second tubular rails 22 and 23. Referring now to FIG. 3, the body support 10 is shown with the upper support rail 20 and chest and knee pads 32 and 34, respectively, removed. Using one of the pivots 21 as a representative example, each plate 36 includes two openings 37 and 38 that extend through the plate 36. Opening 37 includes two notches 37A and 37B, and opening 38 includes three notches 38A, 38B and 38C. Referring again to FIGS. 1 and 2, the ends 18 and 19 of upper support rail 20 each include two posts 39 and 40. Post 39 has a shape complementary to notches 37A and 37B, respectively, and extends through opening 37. Post 40 has a shape complementary to respective notches 38A, 38B and 38C, and extends through opening 38. As is shown in FIG. 4 and using end 18 as a representative example, orienting the posts 39 and 40 on each end 18 and 19 of upper support rail 20 so that the posts 39 and 40 extend through openings 36 and 37, respectively, permits the upper support rail 20 to be moved through an arc and placed in any one of four different positions relative to the support rails 14 and 15. The pivots 21 may alternatively be configured to allow the upper support rail 20 to move among more or less than four positions.

The height of the body support 10 may be changed using the slides 30. As is shown in FIG. 1, each slide 30 includes a plate 42 positioned between the first ends 26 of each pair of tubular rails 22 and 23. As is shown in FIG. 3 and using one of the two plates 42 as a representative example, plate 42 includes two vertically-extending slots 43. Each slot 43 includes multiple, spaced-apart notches 44. As is shown in FIGS. 1 and 2, the slots 43 cooperate with a pair of pins 46. The pins 46 are connected to a crossbar 47 and are received within respective pairs of notches 44. Moving the pins 46 from one pair of notches 44 to another repositions the support rail sections 14 and 15 relative to the base rail sections 11 and 12, respectively, and causes the height of the body support 10 to change.

Referring again to FIG. 3, a series of holes 45 is also defined in plate 42. The holes extend vertically along plate 42 between the first ends 26 of tubular rails 22 and 23, respectively. Crossbar 47 extends between the ends 29 of tubular rails 24 and 25, and includes a hole 48 that is capable of being aligned with a respective one of the holes 45 as the support rail sections 14 and 15 are moved relative to base rail sections 11 and 12, respectively. As is shown in FIGS. 1, 2, and 4, a locking pin 49 is first inserted through hole 48 and then through a selected one of the holes 45 to hold the plate 42 and crossbar 47 in place adjacent to one another.

To adjust the height of the body support 10, each pin 49 is removed from the holes 48 and 45, respectively, and the support rail sections 14 and 15 are moved, relative to respective base rail sections 11 and 12. This allows each pair of pins 46 to be removed from one pair of notches 44, moved along respective slots 43, and repositioned within another pair of notches 44. After the pins 46 have been repositioned, the locking pin 49 is reinserted through hole 48 and into one of the other holes 45. Once the locking pin 49 is in place, each slide 30 maintains both the stability and the new height of the body support 10.

Figure 5:
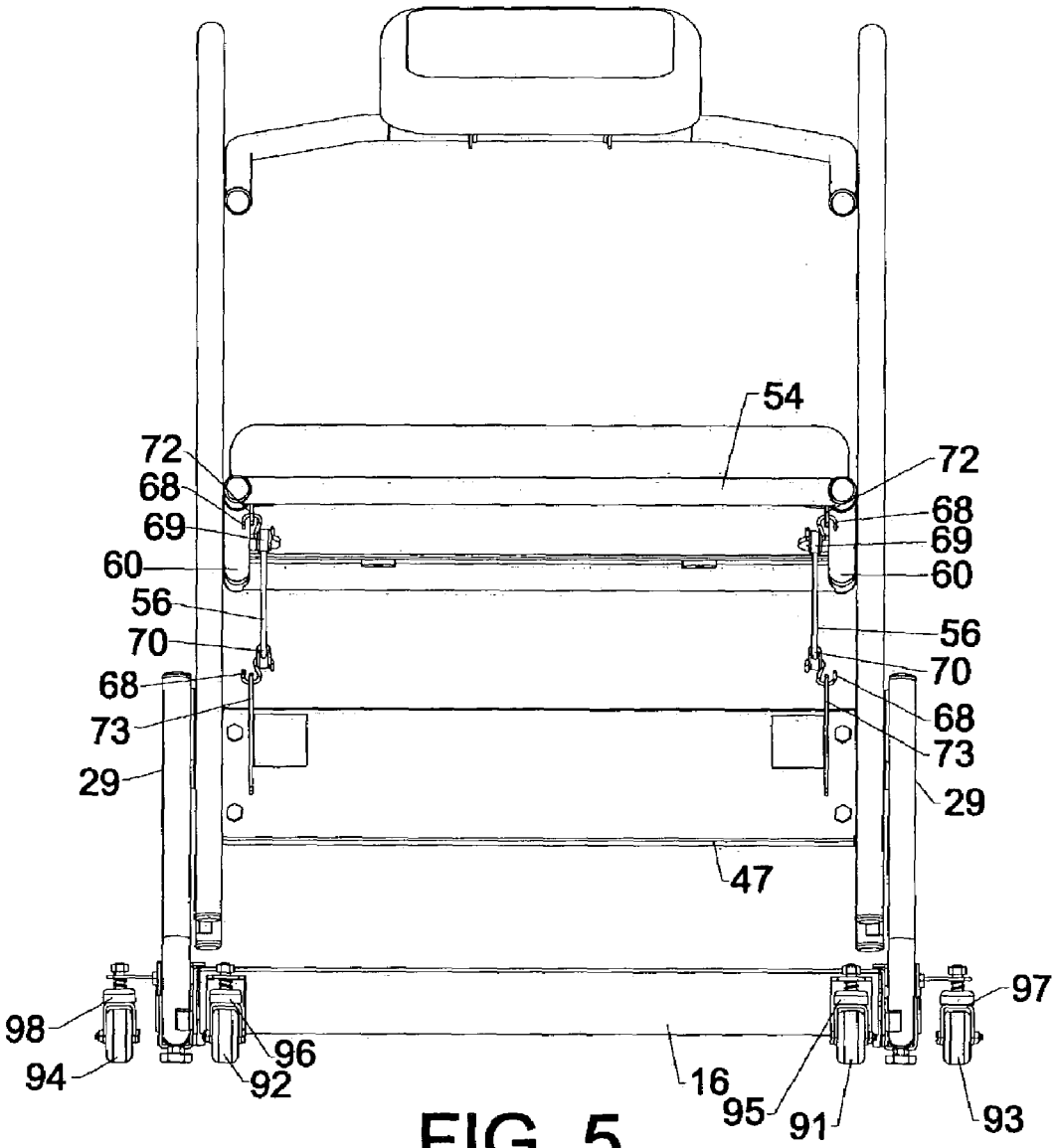
FIG. 5 is a front plan view of the mechanic's body support shown in FIG. 1.

FIGS. 1 and 2 also illustrate the structure of the knee pad 34. While the knee pad 34 may be of any shape or size, the knee pad 34 is preferably rectangularly-shaped, and has a flat, padded surface. The knee pad 34 includes three padded sections 50, 51 and 52, respectively, which are mounted on a tubular frame 54. Although any suitable material may be used, the padded sections 50, 51, and 52 are preferably formed from high density, closed-cell foam padding. As is shown in FIGS. 4 and 5, the frame 54 is connected between base rail sections 14 and 15 using the two sliding pivots 35 and two linking mechanisms 56.

Figure 6:
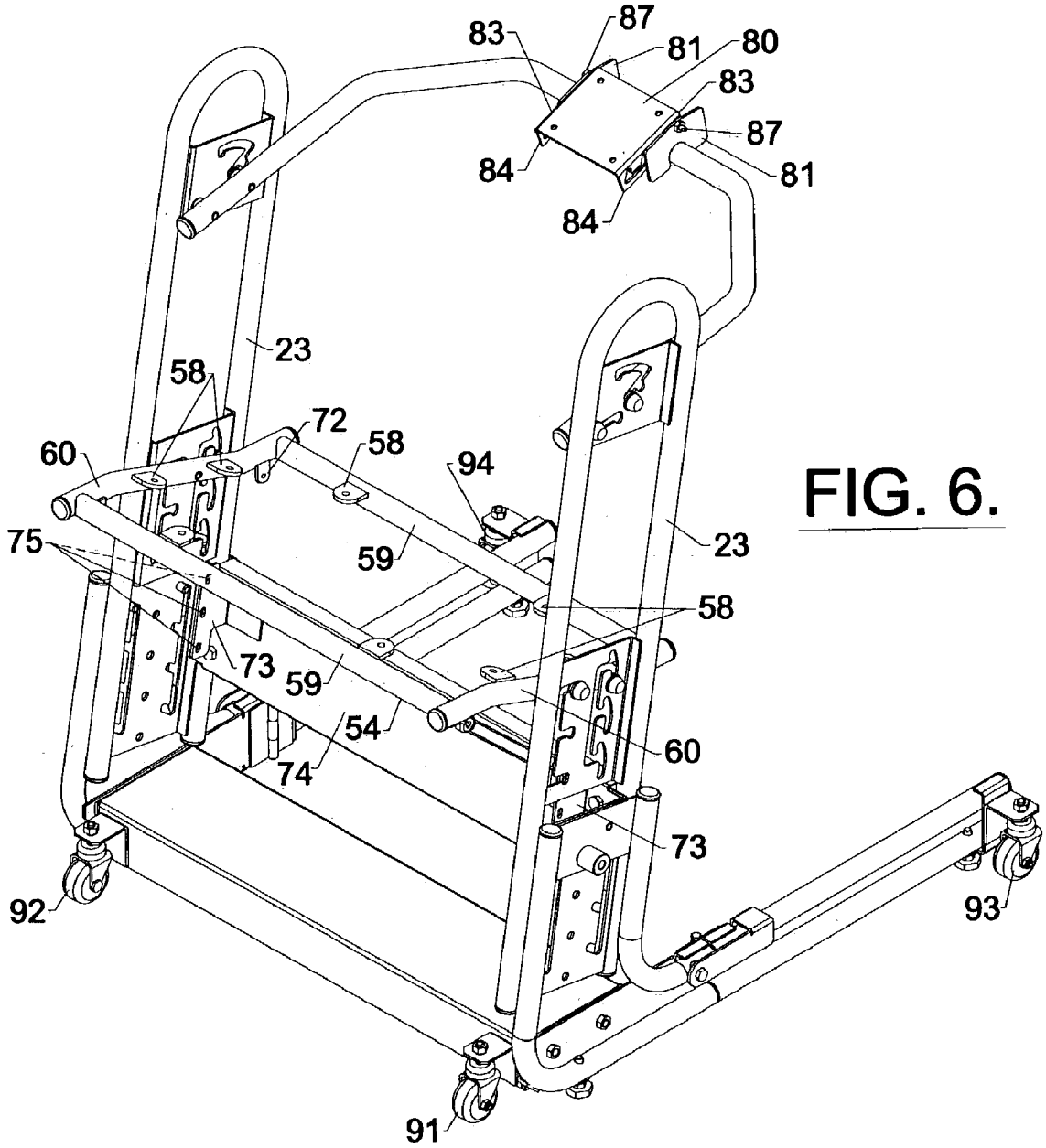
FIG. 6 is a perspective view of the mechanic's body support shown in FIG. 1 with the chest and knee pads removed.
Figure 7:
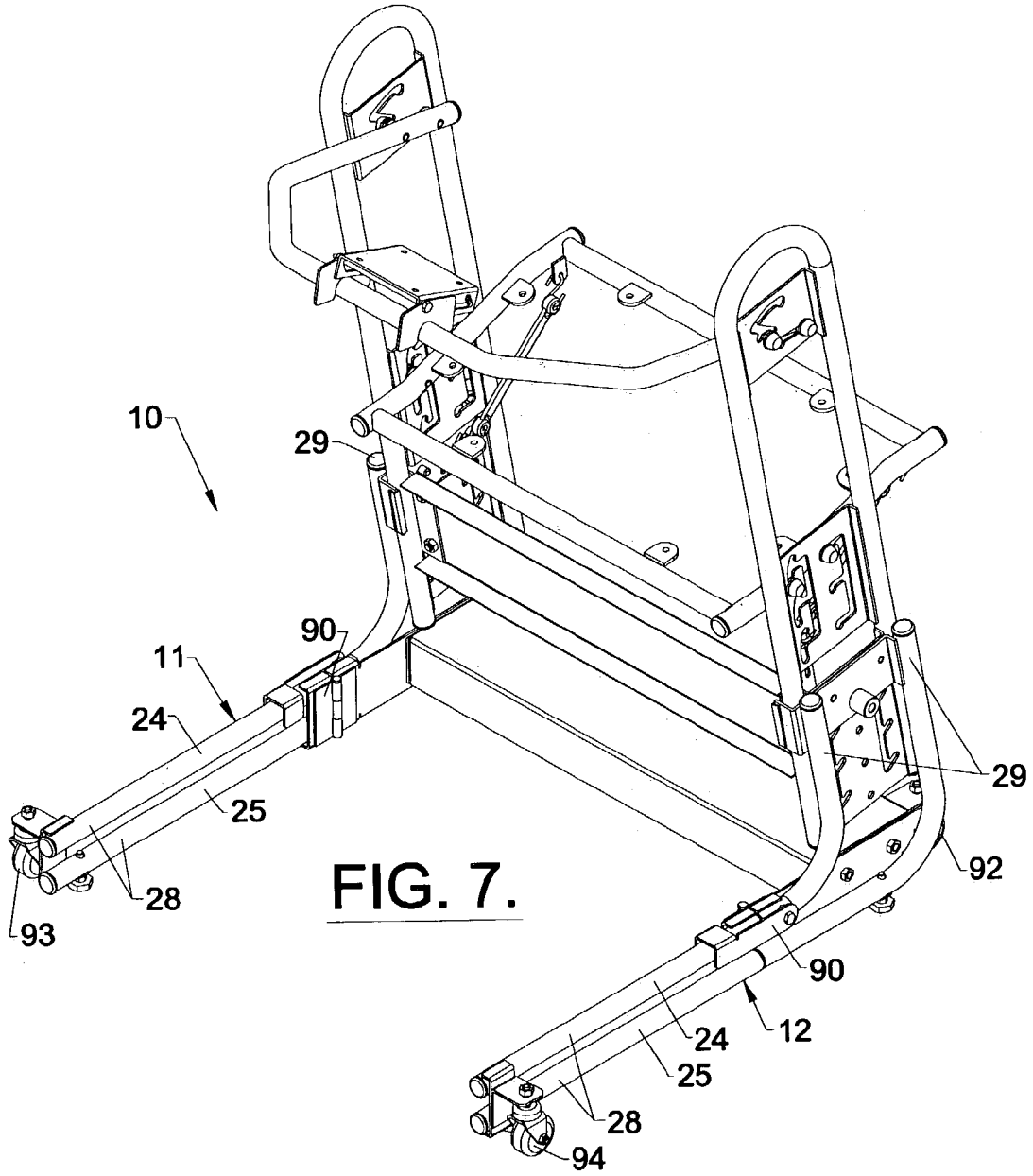
FIG. 7 is another perspective view of the mechanic's body support shown in FIG. 6.

Referring now to FIGS. 6 and 7, the body support 10 is shown with the padded sections 50, 51 and 52, and the chest pad 32 removed. Padded sections 50, 51, and 52 are mounted to the frame 54 by inwardly-extending brackets 58 which are spaced apart around the frame 54. The frame 54 is formed from opposing pairs of major and minor rail segments 59 and 60, respectively. Each minor rail segment 60 has an angular shape which causes the padded sections 50, 51, and 52 to be positioned at ergonomically-correct angles to one another when mounted on the frame 54 for ensuring that the lower legs of the mechanic are adequately supported.

Referring again to FIG. 4, the sliding pivots 35 are used to alter both the height and the angle of the knee pad 34. Using one of the two sliding pivots 35 as a representative example, each pivot 35 includes a plate 61 positioned between the tubular rails 22 and 23. The plate 61 includes two vertically-extending slots 62 and 64, respectively. As is shown in FIG. 3, slot 62 includes three spaced-apart notches 63, and slot 64 includes three spaced-apart, arcuate notches 65. Slots 62 and 64 are defined in plate 61 so that each notch 63 is across from a respective one of the notches 65. As is shown in FIGS. 2 and 4, each pair of notches 63 and 65 receives a pair of complementary pins 66. Each pair of pins 66 is connected to a respective one of the minor rail segments 60 of the frame 54. Moving the pins 66 from one pair of notches 63 and 65 to another repositions the knee pad 34 relative to the support rail sections 14 and 15, and causes the height of the knee pad 34 to change.

The shape of the notches 63 and 65 also permits the knee pad 34 to pivot and be positioned at different angles relative to the support rail sections 14 and 15. Referring again to FIG. 5, the angle of the knee pad 34 is maintained by the linking mechanisms 56. An S-shaped hook 68 is positioned on each of first and second ends 69 and 70 of each linking mechanism 56. The hook 68 positioned on the first end 69 is received within a respective one of two brackets 72 that are attached to the opposing minor rail segments 60 of frame 54. The hook 68 positioned on the second end 70 of each linking mechanism 56 is received within a respective one of two angle-adjusting brackets 73. As is shown in FIG. 6 and using one of the brackets 73 as a representative example, each bracket 73 is connected to a crossbar 74 that extends between and interconnects the tubular rail segments 23.

Three spaced-apart holes 75 extend through each bracket 73. Each hole 75 corresponds to a respective one of the pairs of notches 63 and 65, and receives the S-hook 68 positioned on the second end 70 of the linking mechanism after the height and angle of the knee pad 34' has been adjusted using the sliding pivots 35 as described above. Using the linking mechanisms 56 to connect the knee pad 34 to the crossbar 74 ensures that the knee pad 34 stays connected to the body support 10, yet permits the angle of the knee pad 34 to change in response to the pivotal movement of each pair of pins 66 in a respective one of the pairs of notches 63 and 65.

As is shown in FIG. 6, chest pad 32 is connected to the upper support rail 20 by a base 80. The base 80 is positioned between two brackets 81, which are in turn connected to the upper support rail 20. The base 80 has opposing side edges 83 to which respective slides 84 are connected. FIG. 4 shows the chest pad 32 connected to base 80. Although any suitable material may be used, the chest pad 34 preferably includes high-density, closed-cell foam padding. Using one of the slides 84 as a representative example, each slide 84 defines an elongate slot 85 that extends through the slide 84 and includes multiple notches 86.

As is shown in FIG. 6, a complementary pin 87 is connected to each of the brackets 81. To change the position of the chest pad 32 relative to the upper support rail 20, the pair of pins 87 is removed from one of the pairs of notches 86 and moved to another pair of notches 86.

Figure 8:
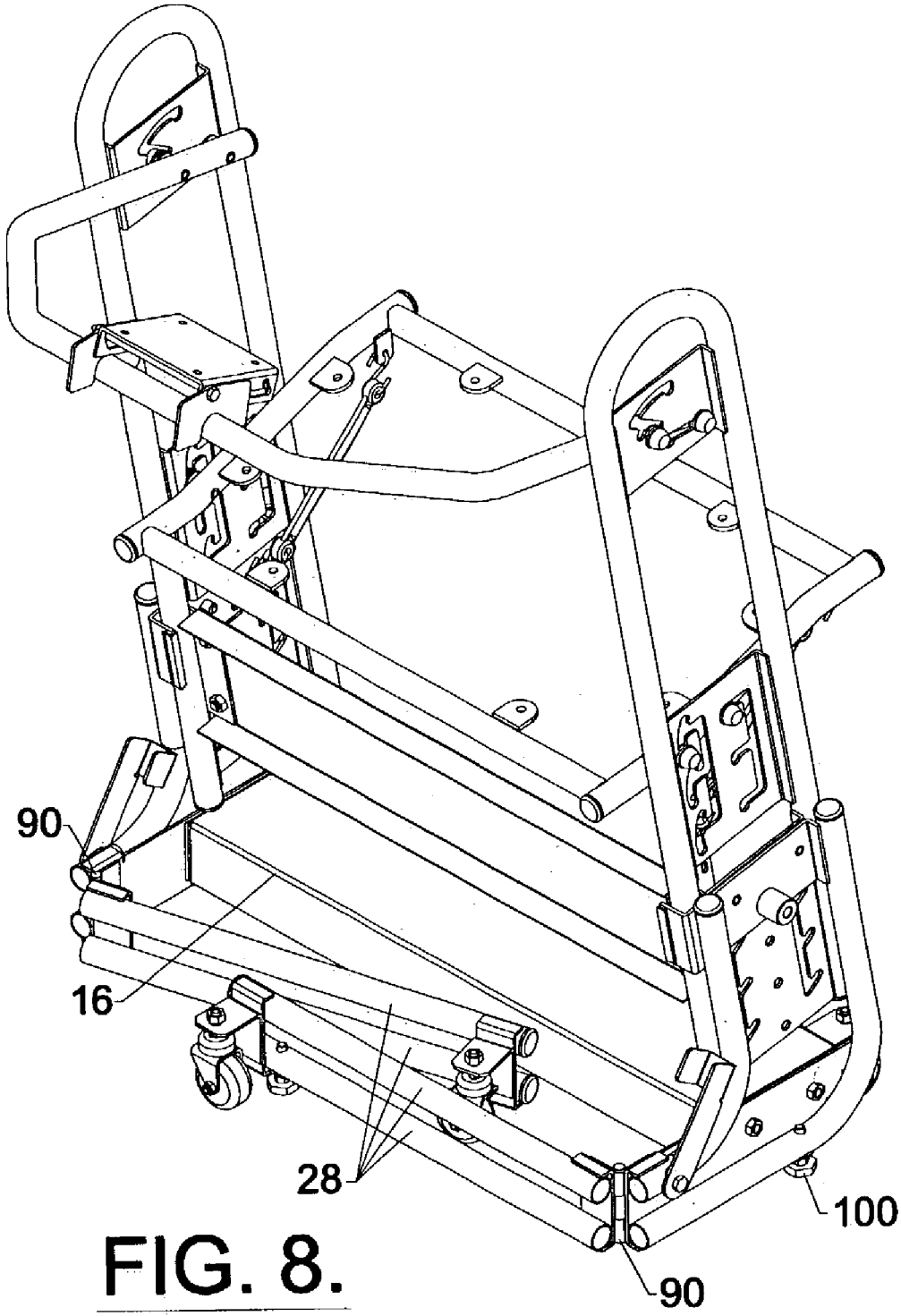
FIG. 8 is a perspective view of the mechanic's body support shown in FIG. 7 with the base rails in a folded, storage configuration.

Referring now to FIGS. 7 and 8, the body support 10 also includes two hinges 90 that are used to move the body support 10 between an extended use position (see FIG. 7) and a closed storage position (see FIG. 8). As is shown in FIG. 7, a hinge 90 is positioned on the base rail segments 24 and 25 of each base rail section 11 and 12. Each hinge 90 is positioned between the straight end 28 and curved end 29 of each base rail section 11 and 12. As is shown in FIG. 8, the hinges 90 permit the straight ends 28 to be moved toward one another and adjacent shelf 16 so that the body support 10 can be easily stored.

The body support 10 can be moved from one location to another using four caster wheels 91, 92, 93 and 94 which are attached to the body support 10, respectively. As is shown in FIG. 1, wheels 91 and 92 are attached to the shelf 16 adjacent curved ends 29 of base rail sections 11 and 12, respectively. As is shown in FIG. 2, wheels 93 and 94 are attached to respective straights ends 28 of base rails 11 and 12. Once the body support 10 has been moved to a particular location, the body support 10 is maintained in place using four adjustable base screws 100. As is shown in FIGS. 1 and 2, each screw 100 is positioned adjacent a respective one of the wheels 91, 92, 93 and 94, and extends through the base rail segment 25. The base screws 100 are used to adjust the height of the body support 10 so that the base rail segments 25 and the wheels 91, 92, 93 and 94 are raised slightly off of the floor, which prevents the body support 10 from inadvertently moving and causing injury to the mechanic.

A body support for automotive mechanics is described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A mechanic's body support, comprising:

(a) a horizontally-extending base;

(b) a generally vertically extending support structure, said support structure having a lower end connected to said base, and an upper end;

(c) a knee pad attached to said support structure between said lower end and said upper end, for supporting the knees of the mechanic;

(d) a chest support rail attached to said upper end of said support structure and extending away from said support structure;

(e) a chest pad attached to said chest support rail, for supporting the chest of the mechanic; and (f) a height adjustment assembly adapted for selectively mounting the knee pad in one of at least two vertical positions relative to the support structure and adapted for selectively mounting the knee pad at one of at least two angles relative to the support structure;

wherein said support structure, said base, said knee pad and said chest pad cooperate to define a structure for supporting a mechanic in an elevated position over an engine compartment of a motor vehicle.

2. A mechanic's body support according to claim 1, wherein said height adjustment assembly comprises at least one slot defined by and extending through the support structure, and the knee pad includes at least one complementary post thereon for cooperating with said at least one slot.

3. A mechanic's body support according to claim 2, wherein said slot and complementary post are each shaped and oriented relative to each other whereby the post is wedged into a selected one of a plurality of notches defined by the slot in response to downward pressure of the knee pad on the post, thereby permitting vertical and pivotal movement of the knee pad relative to the support structure.

4. A mechanic's body support according to claim 1, wherein said support structure includes a length adjustment assembly for permitting the length of the support structure to be adjusted by movement of the support structure relative to the base.

5. A mechanic's body support according to claim 4, wherein said base comprises a pair of spaced-apart base rails, each of said base rails comprising first and second tubular rail segments having respective straight and angled ends.

6. A mechanic's body support according to claim 5, wherein said support structure comprises a pair of spaced-apart support rails, each of said support rails comprising third and fourth tubular rail segments having respective upper and lower ends, wherein each of said lower ends is movably connected to a respective one of said angled ends of the first and second tubular segments of each base rail, and said upper ends are connected together by a U-shaped tubular member.

7. A mechanic's body support according to claim 6, wherein said length adjustment assembly comprises:

(a) a first plate connected between the first and second tubular rail segments of the base rail and including a first hole defined therethrough;

(b) a second plate connected between the third and fourth tubular rail segments of the support rail and including a vertically-oriented series of second holes defined therethrough at spaced-apart intervals; and (c) a locking pin adapted for being inserted through said first hole and through a selected one of said second holes for releasably locking the support rail into a selected one of a plurality of vertical positions relative to the base rail.

8. A mechanic's body support according to claim 7, wherein said chest support rail comprises a U-shaped tubular rail adapted for receiving the chest pad thereon and having terminal ends, each of said ends pivotally connected to a respective one of said U-shaped tubular members for positioning the chest pad relative to the support rails and base rails.

9. A mechanic's body support according to claim 8, wherein the chest pad includes locating members defining complementary rail-receiving indents adapted for receiving said U-shaped tubular rail therein for connecting the chest pad to the U-shaped tubular rail.

10. A mechanic's body support according to claim 8, and including a first pivot connected to each upper support rail segment for pivotally connecting a respective one of the terminal ends of the U-shaped tubular rail thereto for permitting limited movement of the U-shaped tubular rail through an arc for adjusting the pitch of the chest pad.

11. A mechanic's body support according to claim 10, wherein said first pivot comprises:

(a) a third plate connected between the third and fourth tubular rail segments of the support rail;

(b) at least one slot defined by said third plate and extending therethrough, said at least one slot including a series of notches defined therein at spaced-apart intervals; and (c) at least one complementary post included on each of said terminal ends of the U-shaped tubular rail for cooperating with the at least one slot for permitting pivotal movement of the U-shaped tubular rail relative to the support rails.

12. A mechanic's body support according to claim 9, wherein the chest pad includes a fourth plate positioned between and connected to each of said locating members for permitting sliding movement of the chest pad relative to the U-shaped tubular rail.

13. A mechanic's body support according to claim 1, and including at least one wheel positioned on said base for permitting said body support to roll as the body support is being moved.

14. A mechanic's body support according to claim 1, wherein said base is adapted for being moved between an unfolded, fully-extended use configuration and a folded storage configuration for permitting said body support to be stored when not in use.

* * * * *